US007380407B2

(12) United States Patent
Jung et al.

(10) Patent No.: US 7,380,407 B2
(45) Date of Patent: Jun. 3, 2008

(54) MULTI AIR CONDITIONING SYSTEM AND METHOD FOR OPERATING THE SAME

(75) Inventors: Hyun Seok Jung, Gyeonggi-Do (KR); Gyoo Ha Jung, Gyeonggi-Do (KR); Jong Kweon Ha, Gyeonggi-Do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 472 days.

(21) Appl. No.: 11/152,243

(22) Filed: Jun. 15, 2005

(65) Prior Publication Data

US 2006/0026979 A1 Feb. 9, 2006

(30) Foreign Application Priority Data

Aug. 4, 2004 (KR) ..... 10-2004-0061508

(51) Int. Cl.
*F25B 5/00* (2006.01)
*F25B 41/04* (2006.01)

(52) U.S. Cl. ..... 62/200; 62/224

(58) Field of Classification Search ..... 62/159, 62/160, 199, 200, 504
See application file for complete search history.

(56) References Cited

U.S. PATENT DOCUMENTS 5,600,962 A * 2/1997 Aizawa et al. ..... 62/204
7,131,283 B2 * 11/2006 Oh et al. ..... 62/159

FOREIGN PATENT DOCUMENTS

| | | | |
|---|---|---|---|
| JP | 2003287260 A | * | 10/2003 |
| KR | 10-0261268 B1 | | 8/2000 |
| KR | 10-0374815 B1 | | 3/2003 |
| WO | WO 03/081140 A1 | | 10/2003 |

* cited by examiner

*Primary Examiner*—Marc E Norman
(74) *Attorney, Agent, or Firm*—Sughrue Mion, PLLC

(57) ABSTRACT

A multi air conditioning system for adjusting the amount of refrigerant flowing into indoor units determined to be in a stopped state, to improve the overall system efficiency, and a method for operating the multi air conditioning system. The method includes determining whether or not some indoor units are in a stopped state; measuring temperatures of heat exchangers of the indoor units in the stopped state; and changing opening degrees of valves installed in those indoor units determined to be in the stopped state to change the amount of refrigerant flowing therein if the temperatures of the heat exchangers of the stopped indoor units deviate from a reference range.

11 Claims, 3 Drawing Sheets

MULTI AIR CONDITIONING SYSTEM AND METHOD FOR OPERATING THE SAME

CROSS-REFERENCE TO RELATED APPLICATION

This application claims the benefit of Korean Patent Application No. 10-2004-0061508, filed Aug. 4, 2004, in the Korean Intellectual Property Office, the disclosure of which is incorporated herein by reference.

BACKGROUND OF THE INVENTION

1. Field of the Invention

The present invention relates to a multi air conditioning system and a method for operating the same, and more particularly to a multi air conditioning system, which adjusts opening degrees of indoor units in a stopped state to control the optimum amount of refrigerant flowing into indoor units in an operating state, and a method for operating the multi air conditioning system.

2. Description of the Related Art

Generally, a multi air conditioning system comprises one outdoor unit, a plurality of indoor units connected to the outdoor unit, and electric valves for adjusting the amount of refrigerant entering into the indoor units.

The above conventional multi air conditioning system operates compressors in a cooling mode or a heating mode, and adjusts opening degrees of the electric valves installed in the indoor units, thus controlling the amount of refrigerant entering into the indoor units. In case that predetermined temperatures of the indoor units differ from each other, the indoor units are operated at different operating capacities so as to optimally condition air in indoor spaces, in which the indoor units are installed.

Further, when some indoor units of the plural indoor units are stopped, the opening degrees of the electric valves installed in the indoor units in a stopped state are maintained to predetermined values, and the opening degrees of the electric valves installed in the indoor units in an operating state are changed to proper values according to the operating conditions of the multi air conditioning system. Korean Patent Laid-open No. 2003-0073358 discloses the conventional multi air conditioning system in detail, and is incorporated herein by reference.

When only some of the plural indoor units are operated, the above-described conventional multi air conditioning system maintains the electric valves of those indoor units in the stopped state to have constant opening degrees regardless of the operating conditions of the overall system. Thus, the conventional multi air conditioning system is disadvantageous in that the overall system efficiency is decreased when the amount of the refrigerant flowing into the indoor units in the operating state is not proper.

That is, when the opening degrees of the electric valves of the indoor units in the stopped state are excessively high, a large amount of the refrigerant flows into the stopped indoor units whereas a small amount of the refrigerant flows into the indoor units in the operating state, thereby reducing the heating and cooling efficiency of the system.

On the other hand, when the opening degrees of the electric valves of the stopped indoor units are excessively low, the refrigerant scarcely flows into those stopped indoor units, and part of the refrigerant is trapped in heat exchangers of the stopped indoor units (particularly, in the heating mode), thereby reducing the amount of the refrigerant circulating into the refrigerant route and thus reducing the heating and cooling efficiency of the system.

SUMMARY OF THE INVENTION

Therefore, an object of the invention is to provide a multi air conditioning system for adjusting the amount of refrigerant flowing into indoor units in a stopped state, to improve the overall system efficiency, and a method for operating the multi air conditioning system.

In accordance with one exemplary embodiment, a method is provided for operating a multi air conditioning system having a plurality of indoor units, comprising: determining whether or not some indoor units are in a stopped state; measuring temperatures of heat exchangers of those indoor units in the stopped state; and changing opening degrees of valves installed in the stopped indoor units to change the amount of refrigerant flowing into the stopped indoor units if the temperatures of the heat exchangers of the stopped indoor units deviate from a reference range.

In accordance with another exemplary embodiment, a method is provided for operating a multi air conditioning system having a plurality of indoor units, comprising: determining, in a heating mode of the system, whether or not some indoor units are in a stopped state; measuring temperatures of pipes connected to heat exchangers of the indoor units in the stopped state; and increasing opening degrees of valves for adjusting the amount of refrigerant flowing into the stopped indoor units if the temperatures of the pipes connected to the heat exchangers of the stopped indoor units are lower than a first reference temperature, and decreasing the opening degrees of the valves, in case that the temperatures of the pipes are higher than a second reference temperature In accordance with yet another object, a multi air conditioning system is provided having a plurality of indoor units, comprising: a plurality of valves for adjusting the amount of refrigerant flowing into the indoor units; a plurality of pipe temperature sensors for measuring temperatures of pipes connected to heat exchangers of the indoor units; and a controller for changing opening degrees of valves installed in the stopped indoor units if the temperatures of the pipes measured by the pipe temperature sensors of the stopped indoor units deviate from a reference range.

BRIEF DESCRIPTION OF THE DRAWINGS

These and/or other aspects and advantages of the invention will become apparent and more readily appreciated from the following description of the exemplary embodiments, taken in conjunction with the accompanying drawings in which.

DETAILED DESCRIPTION OF THE PREFERRED EMBODIMENTS

Figure 1:
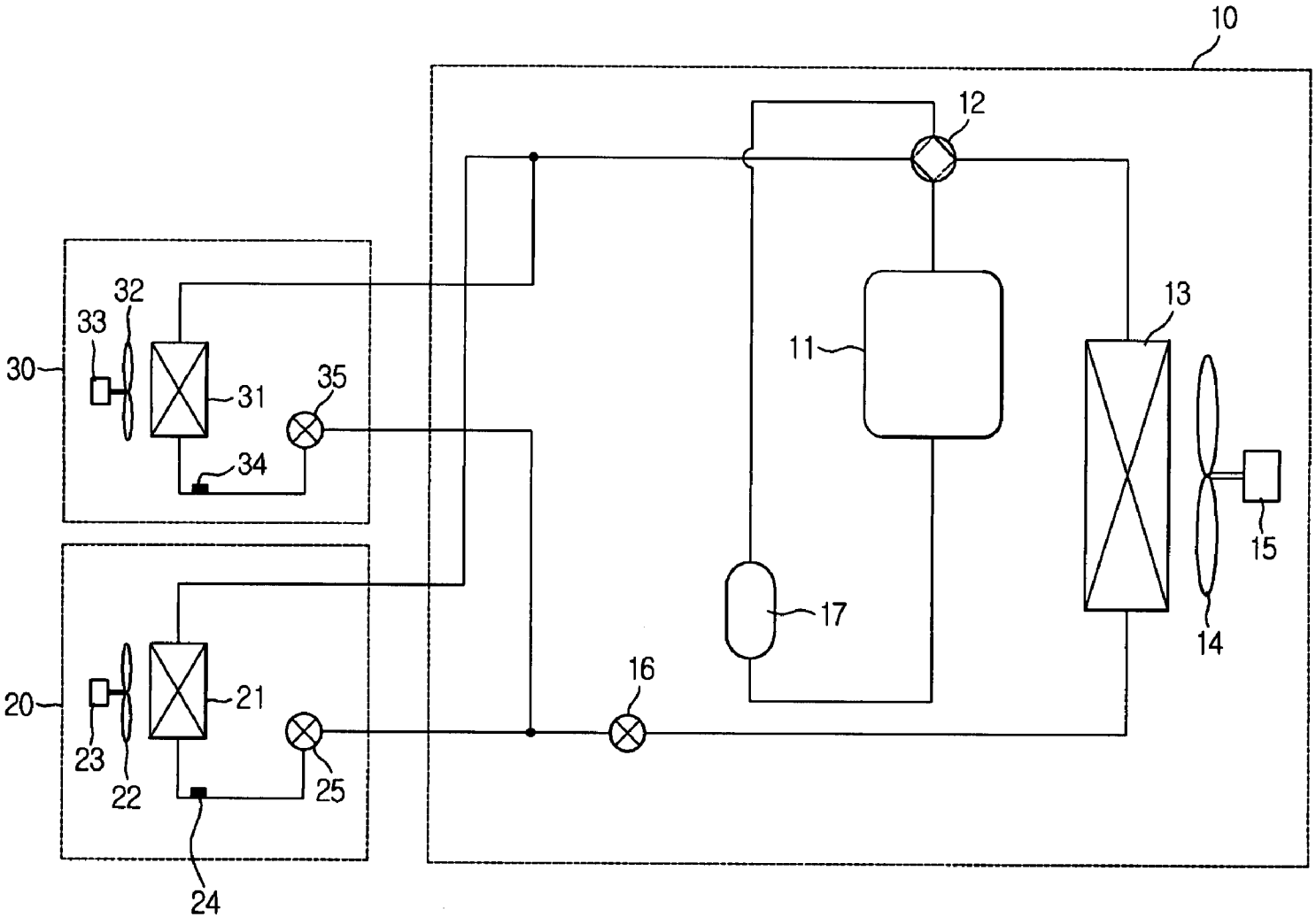
FIG. 1 is a schematic view illustrating a route of a refrigerant of a multi air conditioning system in accordance with one exemplary embodiment of the present invention.

Reference will now be made in detail to the exemplary embodiment of the present invention, an example of which is illustrated in the accompanying drawings, wherein like reference numerals refer to like elements throughout. The embodiment is described below by referring to the figures.

Figure 2:
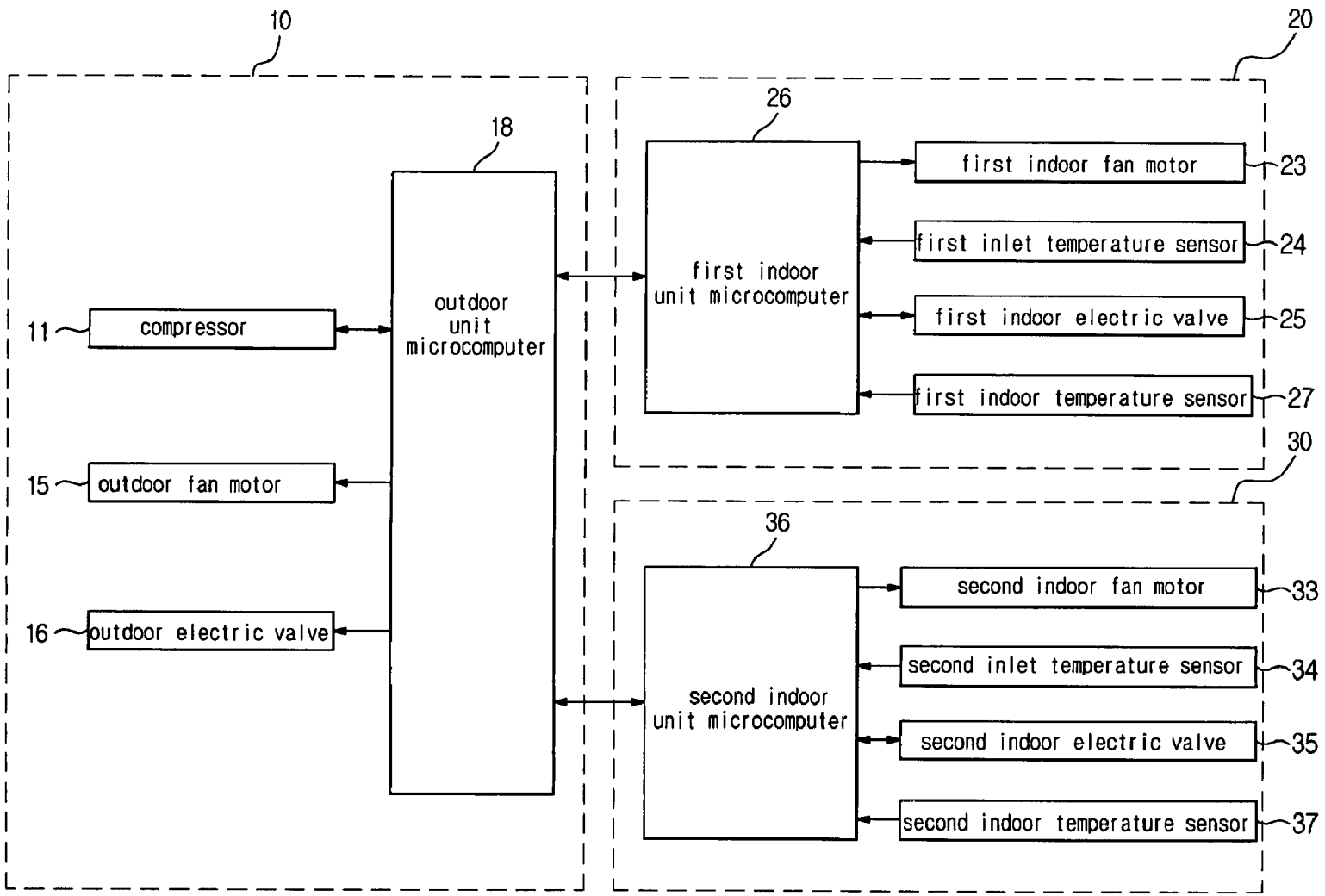
FIG. 2 is a block diagram of the multi air conditioning system shown in FIG. 1.

As shown in FIGS. 1 and 2, a multi air conditioning system in accordance with one exemplary embodiment comprises an outdoor unit 10, and first and second indoor units 20 and 30 connected to the outdoor unit 10.

The outdoor unit 10 includes a compressor 11 for compressing a refrigerant, a four-way valve 12 for adjusting the flow direction of the refrigerant discharged from the compressor 11, an outdoor heat exchanger 13 for receiving the refrigerant compressed by the compressor 11 and exchanging heat between the refrigerant and external air, an outdoor fan 14 for forcibly blowing air to the outdoor heat exchanger 13, and an outdoor fan motor 15 for rotating the outdoor fan 14.

The outdoor unit 10 further includes an outdoor electric valve 16 for expanding the refrigerant, an accumulator 17 for transmitting the refrigerant in a gaseous state to the compressor 11, and an outdoor unit microcomputer 18 (FIG. 2) for controlling the components of the outdoor unit 10 and communicating data with indoor unit microcomputers 26 and 36.

The first and second indoor units 20 and 30 respectively include first and second indoor heat exchangers 21 and 31 for receiving internal air and exchanging heat with the internal air, first and second indoor fans 22 and 32 for inhaling the internal air from the outside of the indoor units 20 and 30, causing the internal air to pass through the first and second heat exchangers 21 and 31, and discharging the internal air to the outside of the indoor units 20 and 30, and first and second indoor fan motors 23 and 33 for rotating the first and second indoor fans 22 and 32.

The first and second indoor units 20 and 30 respectively further include first and second indoor electric valves 25 and 35 for adjusting the amount of the refrigerant flowing into the first and second indoor units 20 and 30, first and second inlet temperature sensors 24 and 34 installed at pipes located at inlets of the first and second indoor heat exchangers 21 and 31, through which the refrigerant enters into the first and second indoor heat exchangers 21 and 31 (in the cooling mode), first and second indoor temperature sensors 27 and 37 for measuring the temperatures of spaces, in which the first and second indoor units 21 and 31 are installed, and the first and second indoor unit microcomputers 26 and 36 for controlling the components of the first and second indoor units 20 and 30 and for communicating data with the outdoor unit microcomputer 18.

Figure 3:
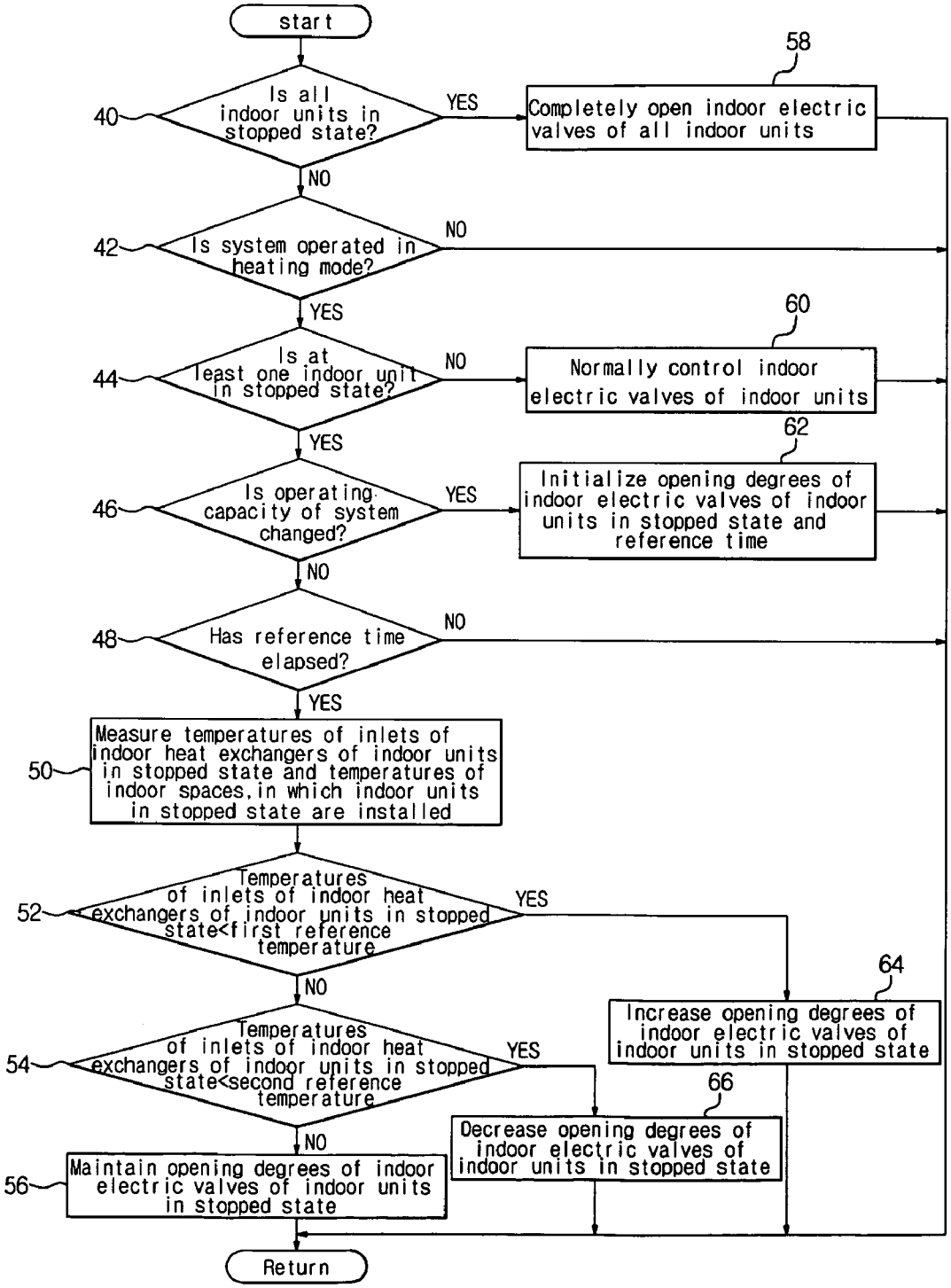
FIG. 3 is a flow chart illustrating a method for operating the multi air conditioning system shown in FIGS. 1 and 2.

Now, with reference to FIG. 3, a method for operating the multi air conditioning system shown in FIGS. 1 and 2 will be described in detail. When the operation of the outdoor unit microcomputer 18 is started, the outdoor unit microcomputer 18 communicates data with the first and second indoor unit microcomputers 26 and 36 and inspects operating conditions of the first and second indoor units 20 and 30. Then, the outdoor unit microcomputer 18 determines whether or not both the first and second indoor units 20 and 30 are in a stopped state (S40). In case that both the first and second indoor units 20 and 30 are in the stopped state, then the indoor electric valves 25 and 35 of the first and second indoor units 20 and 30 are completely opened so that pressure equilibration of the overall route of the refrigerant is performed (S58).

In case that both the first and second indoor units 20 and 30 are not in the stopped state, it is determined whether or not the multi air conditioning system is operated in the heating mode (S42). In case that it is determined that the multi air conditioning system is not operated in the heating mode, the method is returned to the initial step. If, however, it is determined that the multi air conditioning system is operated in the heating mode, then it is inspected whether or not at least one of the first and second indoor unit 20 and 30 is in the stopped state (S44).

In case that it is inspected that at least one of the first and second indoor units 20 and 30 is not in the stopped state, then it is determined that all of the first and second indoor units 20 and 30 are operated, and the first and second indoor electric valves 25 and 35 of the first and second indoor units 20 and 30 are normally controlled (S60). If it is inspected that at least one of the first and second indoor units 20 and 30 is in the stopped state, then it is determined whether or not the operating capacity of the system is changed (S46).

The change of the operating capacity of the system is caused by the change of the states of the first and second indoor units 20 and 30, i.e., the change of the operating state to the stopped state or the change of the stopped state to the operating state. In case that the operating capacity of the system is changed, the opening degree of the indoor electric valve of the indoor unit in the stopped state is initialized to a predetermined value, and a reference time is initialized (S62).

Here, the opening degree of the indoor electric valve of the indoor unit in the stopped state varies according to the system. The opening degree of the indoor electric valve of the indoor unit in the stopped state is set to a proper value by experimentation, and is stored in advance by the microcomputer. Further, the reference time is set in consideration of a time taken to stabilize the system from the time when the operating capacity of the overall system is changed.

In case that it is determined that the operating capacity of the system is not changed in step S46, it is determined whether or not the reference time has elapsed (S48). In case that it is determined that the reference time had not elapsed, it is determined that the system is not stabilized after the change of the operating capacity of the system, and the method is returned to the initial step, and in case that it is determined that the reference time has elapsed, then the temperature of the inlet of the indoor heat exchanger of the indoor unit in the stopped state is measured by the inlet temperature sensor of the indoor unit in the stopped state, and the temperature of the indoor space, in which the indoor unit in the stopped state is installed, is measured by the indoor temperature sensor of the indoor unit in the stopped state (S50).

Thereafter, it is determined whether or not the temperature of the inlet of the indoor heat exchanger of the indoor unit in the stopped state is lower than a first reference temperature (S52). The first reference temperature varies according to the type of compressor 11 or other configurations of the system. Preferably, in this embodiment, the first reference temperature is set above the temperature of the indoor space, in which the indoor unit in the stopped state is installed, by approximately 20° C. That is, in step S52, it is determined whether or not the temperature of the inlet of the indoor heat exchanger of the indoor unit in the stopped state is lower than the value obtained by adding a designated temperature to the temperature of the indoor space measured by the indoor temperature sensor.

In case that it is determined that the temperature of the inlet of the indoor heat exchanger of the indoor unit in the stopped state is lower than the first reference temperature, the opening degree of the indoor electric valve of the indoor unit in the stopped state is increased (S64). When the opening degree of the indoor electric valve of the indoor unit in the stopped state is excessively low, the refrigerant is trapped in the indoor heat exchanger of the indoor unit in the stopped state and changed in phase, thereby decreasing the temperature of the inlet of the indoor heat exchanger below the first reference temperature. Thus, in this case, the opening degree of the indoor electric valve is increased so that the refrigerant is not trapped in the indoor heat exchanger of the indoor unit in the stopped state, thereby increasing the amount of the refrigerant circulating along the route of the refrigerant.

In case that it is determined that the temperature of the inlet of the indoor heat exchanger of the indoor unit in the stopped state is not lower than the first reference temperature, it is determined whether or not the temperature of the inlet of the indoor heat exchanger of the indoor unit in the stopped state is higher than a second reference temperature (S54).

The second reference temperature varies according to the capacity of the compressor 11 or other configurations of the system. Preferably, in this embodiment, the second reference temperature is set above the temperature of the indoor space, in which the indoor unit in the stopped state is installed, by approximately 30° C. That is, in step S54, it is determined whether or not the temperature of the inlet of the indoor heat exchanger of the indoor unit in the stopped state is higher than the value obtained by adding a designated temperature to the first reference temperature.

In case that it is determined that the temperature of the inlet of the indoor heat exchanger of the indoor unit in the stopped state is higher than the second reference temperature, then the opening degree of the indoor electric valve of the indoor unit in the stopped state is decreased (S66). When the opening degree of the indoor electric valve of the indoor unit in the stopped state is excessively high, an excessively large amount of the refrigerant in a high-temperature and high-pressure state discharged from the compressor flows into the indoor heat exchanger of the stopped indoor unit, thereby increasing the temperature of the inlet of the indoor heat exchanger above the second reference temperature. Thus, in this case, the opening degree of the indoor electric valve is decreased so that the amount of the refrigerant flowing into the indoor heat exchanger of the indoor unit in the stopped state is decreased and a large amount of the refrigerant flows into the indoor unit in the operating state.

In case that it is determined that the temperature of the inlet of the indoor heat exchanger of the indoor unit in the stopped state is not higher than the second reference temperature, then it is determined that the opening degree of the indoor electric valve of the indoor unit in the stopped state is proper, and the set opening degree of the indoor electric valve is maintained (S56).

In this embodiment, the first and second inlet temperature sensors 24 and 34 are installed at the inlets of the indoor heat exchangers (in the cooling mode), and the temperature sensors for indirectly measuring the amount of the refrigerant flowing into the indoor heat exchanger of the indoor unit in the stopped state are installed around the pipes connected to the outlets of the indoor heat exchangers (in the cooling mode), the indoor heat exchangers, or peripheries of the indoor heat exchangers. Here, the first reference temperature and the second reference temperatures are set to different values.

As apparent from the above description, the exemplary embodiment provides a multi air conditioning system comprising a plurality of indoor units, which adjusts the amount of refrigerant flowing into some indoor units in a stopped state, and a method for operating the multi air conditioning system, thereby causing the proper amount of the refrigerant to flow into indoor units in an operating state.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A method for operating a multi air conditioning system having a plurality of indoor units, comprising:

determining whether at least one of the indoor units is in a stopped state;

measuring a temperature of heat exchangers of the at least one indoor unit determined to be in the stopped state; and changing an opening degree of a valve installed in the at least one indoor unit determined to be in the stopped state to change the amount of refrigerant flowing therein if the temperatures of the heat exchanger of the at least one indoor unit determined to be in the stopped state deviates from a reference ranges, wherein the reference range is between a first reference temperature, set above a temperature of an indoor space, in which the at least one indoor unit determined to be in the stopped state is positioned, by a designated amount, and a second reference temperature, set above the first reference temperature by another designated amount.

2. The method according to claim 1, wherein the temperature of the heat exchanger of the at least one indoor unit determined to be in the stopped state is a temperature of a pipe connected to the heat exchanger of the at least one stopped indoor unit.

3. The method according to claim 2, wherein the temperature is a temperature of an inlet of the heat exchanger of the determined at least one indoor unit in a cooling mode.

4. The method according to claim 2, wherein the multi air conditioning system is operated in a heating mode.

5. The method according to claim 4, wherein the opening degree of the valve is increased if the temperature of the pipe connected to the heat exchanger of the at least one indoor unit determined to be in the stopped state is lower than the first reference temperature.

6. The method according to claim 4, wherein the opening degree of the valve is decreased in case that the of the pipe connected to the heat exchanger of the at least one indoor unit determined to be in the stopped state is higher than the second reference temperature.

7. The method according to claim 2, wherein the opening degree of the valve is maintained if the temperature of the pipe connected to the heat exchanger of the at least one indoor unit determined to be in the stopped state is within the reference range.

8. A method for operating a multi air conditioning system having a plurality of indoor units, comprising:

determining, in a heating mode of the system, whether or not at least one of the indoor units is in a stopped state;

measuring a temperature of a pipe connected to a heat exchanger of the at least one indoor unit determined to be in the stopped state; and increasing an opening degree of the valve for adjusting the amount of refrigerant flowing therein if the temperature of the pipe connected to the heat exchanger of the at least one indoor unit determined to be in the stopped state is lower than a first reference temperature, and decreasing the opening degree of the valve if the temperature of the pipe is higher than a second reference temperature, wherein the first reference temperature is set above a temperature of an indoor space, in which the at least one indoor unit determined to be in the stopped state is positioned, by a designated amount, and the second reference temperature is set above the first reference temperature by another designated amount.

9. A multi air conditioning system having a plurality of indoor units, comprising:

a plurality of valves for respectively adjusting the amount of refrigerant flowing into the indoor units;

a plurality of pipe temperature sensors for respectively measuring temperatures of pipes connected to heat exchangers of the indoor units; and a controller for changing opening degrees of the valves installed in those indoor units determined to be in a stopped state if the temperatures of the pipes measured by the pipe temperature sensors of those indoor units determined to be in the stopped state deviate from a reference range wherein the reference range is between a first reference temperature, set above a temperature of an indoor space, in which the at least one indoor unit determined to be in the stopped state is positioned, by a designated amount, and a second reference temperature, set above the first reference temperature by another designated amount.

10. The multi air conditioning system according to claim 9, further comprising a plurality of indoor temperature sensors for respectively measuring temperatures of spaces in which the indoor units are installed, wherein:

the multi air conditioning system is operated in a heating mode; and the reference range is between a first reference temperature, set above a temperature of indoor spaces in which the indoor units determined to be in a stopped state are positioned, by a designated temperature, and a second reference temperature, set above the first reference temperature by another designated temperature.

11. The multi air conditioning system according to claim 10, wherein the controller increases the opening degrees of valves installed in those indoor units determined to be in the stopped state, if the temperatures of the pipes connected to the heat exchangers of the indoor units determined to be in the stopped state are lower than the first reference temperature, and decreasing the opening degrees of the valves, if the temperatures of the pipes are higher than the second reference temperature.

* * * * *